US007831185B2

(12) United States Patent
Masubuchi et al.

(10) Patent No.: US 7,831,185 B2
(45) Date of Patent: Nov. 9, 2010

(54) IMAGE FORMING APPARATUS CAPABLE OF SMOOTH TRANSMISSION OF RECORDING MEDIUM

(75) Inventors: Fumihito Masubuchi, Yokohama (JP); Tetsuo Watanabe, Yokohama (JP); Katsuaki Miyawaki, Yokohama (JP); Takashi Seto, Yokohama (JP); Makoto Komatsu, Ninomiya-machi (JP)

(73) Assignee: Ricoh Co., Ltd., Tokyo (JP)

( * ) Notice: Subject to any disclaimer, the term of this patent is extended or adjusted under 35 U.S.C. 154(b) by 1050 days.

(21) Appl. No.: 11/474,465

(22) Filed: Jun. 26, 2006

(65) Prior Publication Data

US 2007/0008395 A1 Jan. 11, 2007

(30) Foreign Application Priority Data

Jun. 29, 2005 (JP) ..... 2005-189547

(51) Int. Cl.
*G03G 15/20* (2006.01)

(52) U.S. Cl. ..... 399/313; 399/302

(58) Field of Classification Search ..... 399/302, 399/307, 313

See application file for complete search history.

(56) References Cited

U.S. PATENT DOCUMENTS 5,351,114 A * 9/1994 Matsuno ..... 399/307
6,324,374 B1 11/2001 Sasamoto et al.
6,556,802 B2 4/2003 Sasamoto et al.
6,768,891 B2 7/2004 Sasamoto et al.
6,941,102 B2 9/2005 Sasamoto et al.
6,949,896 B2 9/2005 Andoh et al.
7,054,585 B2 5/2006 Sasamoto et al.
2004/0013452 A1 * 1/2004 Choi ..... 399/313
2005/0099153 A1 5/2005 Komatsu et al.

FOREIGN PATENT DOCUMENTS

JP 11-052743 2/1999

* cited by examiner

*Primary Examiner*—David M Gray
*Assistant Examiner*—Laura K Roth
(74) *Attorney, Agent, or Firm*—Harness, Dickey & Pierce, P.L.C.

(57) ABSTRACT

Disclosed is an image forming apparatus including a first member having a surface endlessly moving in a specific direction a second member having a surface endlessly moving in the specific direction at a region facing the surface of the first member, and a supporting member holding the second member and to move together with the second member. The supporting member includes a release mechanism to release an engagement of the supporting member from the second member. A pressing member is included to press the second member via the supporting member to cause the second member to contact the first member under pressure to form a nip between the first and second members. The release mechanism releases the engagement of the supporting member from the second member when the second member is pushed away by a leading edge of a recording medium having a thickness greater than a reference thickness value.

19 Claims, 8 Drawing Sheets

IMAGE FORMING APPARATUS CAPABLE OF SMOOTH TRANSMISSION OF RECORDING MEDIUM

PRIORITY STATEMENT

This patent specification is based on Japanese patent application, No. 2005-189547 filed on Jun. 29, 2005 in the Japan Patent Office, the entire contents of which are incorporated by reference herein.

BACKGROUND

1. Field

This patent specification generally describes an image forming apparatus. For example, it generally describes one capable of smooth transmission of recording medium.

2. Discussion of the Background

Background image forming apparatuses, such as printers, facsimiles, copiers, and multifunction apparatuses which print, fax, copy, and so on generally use an electrophotographic process for image forming. The electrophotographic process includes a charging process of an image carrier, a latent image forming process to form the image on the image carrier, a developing process in which toner is adhered, a transferring process which transfers the toner image to an intermediate transfer belt and transfers the toner image to the recording medium at a transfer device and a fixing process to fix the toner image at a fixing apparatus.

The transfer device forms a transfer nip by a pressuring force of a spring mechanism so as to contact a transfer roller with a pressure to the intermediate transfer belt which is the image carrier moving endlessly. The transfer roller is pressed in a direction of a thickness of the recording medium so as to give a pressure to any recording medium even if the recording medium is thick.

When the recording medium is conveyed to the transfer nip, a necessary space equal to a thickness of the recording medium is formed by a pushing force of a leading edge of the recording medium so that the recording medium pass through the transfer nip. If the recording medium is thin, the necessary space for the thickness of the recording medium is easily formed by a reform of a rubber layer of the transfer roller. The thin recording medium can pass through the transfer nip without stacking at the transfer nip.

If the recording medium is thick, it is not possible to obtain a necessary space for the thickness of the recording medium simply by the reform of the rubber layer of the transfer roller. It is needed that the transfer roller is retracted by the leading edge of the recording medium to form the necessary space. Otherwise, the recording medium can not enter the transfer nip and stack at a position immediately before the transfer nip until the necessary space for the thickness of the recording medium is formed.

If the stacking of the recording medium occurred for a relatively long time, a load to the intermediate transfer belt is increased due to a friction between the recording medium and the intermediate transfer belt. Due to the increase of the load of the intermediate transfer belt, a speed of the intermediate transfer belt may change. As a result, an uniformity of the color density which is called a shock jitter is occurred.

SUMMARY

This patent specification describes at least one embodiment of a novel image forming apparatus which includes a first member having a surface endlessly moving in a specific direction a second member having a surface endlessly moving in the specific direction at a region facing the surface of the first member, a supporting member to hold the second member and to move together with the second member, the supporting member including a release mechanism to release an engagement of the supporting member from the second member and a pressing member to press the second member via the supporting member to cause the second member to contact the first member under pressure to form a nip between the first and second members. The release mechanism releases the engagement of the supporting member from the second member when the second member is pushed away by a leading edge of a recording medium having a thickness greater than a reference thickness value.

This patent specification further describes at least one embodiment of a novel image forming apparatus which includes a release mechanism having a detector to detect an event that the second member is pushed away by a recording medium having a thickness greater than the reference thickness value and an actuator to be driven to rapidly decrease the spring constant of the spring mechanism in response to a detection of the event by the detector.

Further, the patent specification describes at least one embodiment wherein the detector detects an event that a trailing edge of the recording medium having a thickness greater than the reference thickness value exits from the nip and the actuator is driven to rapidly increase the spring constant of the spring mechanism in response to a detection of the event by the detector.

BRIEF DESCRIPTION OF THE DRAWINGS

A more complete appreciation of the disclosure and many of the attendant advantages thereof will be readily obtained as the same becomes better understood by reference to the following detailed description of example embodiments when considered in connection with the accompanying drawings, wherein.

DETAILED DESCRIPTION OF EXAMPLE EMBODIMENTS

Figure 1:
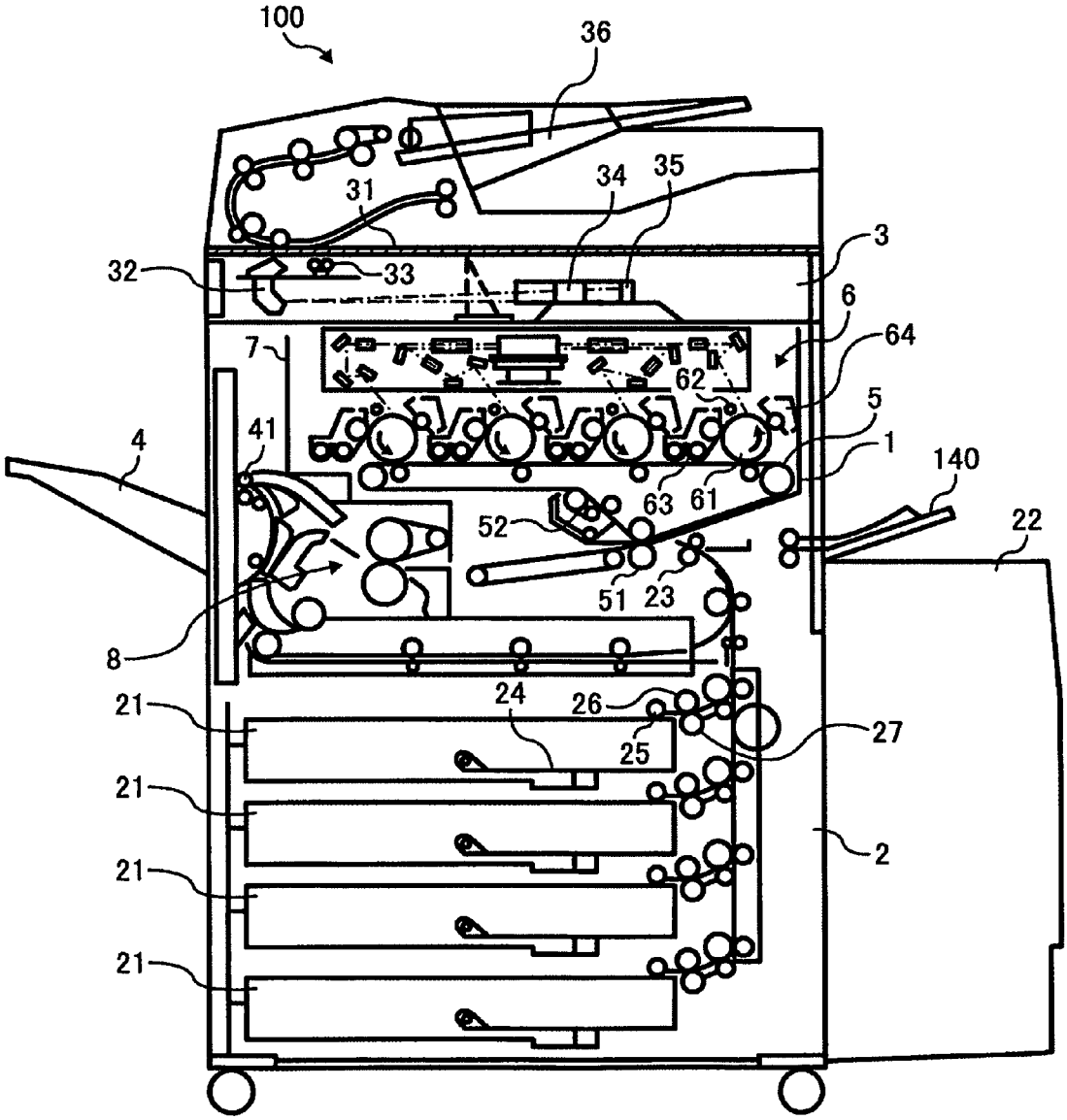
FIG. 1 illustrates an image forming apparatus according to a first example embodiment.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 2:
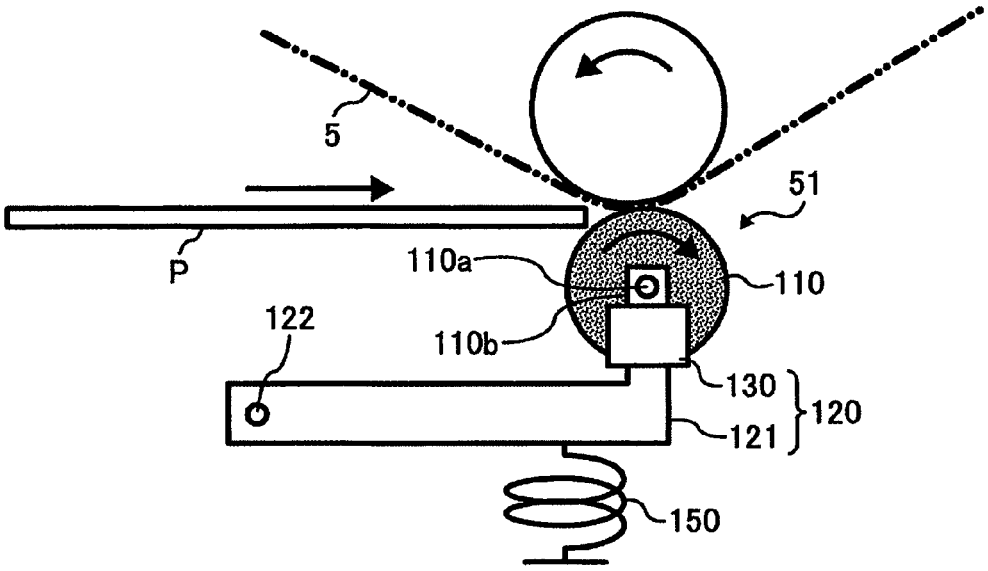
FIG. 2 illustrates a schematic of a transfer device of FIG. 1.

Referring now to the drawings, wherein like reference numerals designate identical or corresponding parts throughout the several views, particularly to FIG. 2, a transfer device for image forming apparatus according to an embodiment of the present invention is described.

FIG. 1 illustrates an image forming apparatus 100 according to a first example embodiment. The image forming apparatus 100 is a multifunction peripheral (MFP) apparatus which is capable of copying, printing, faxing, scanning, storing, and so on. The MFP is called a digital color copying apparatus and copies a document by being scanned, read, digitized and printed to a recording medium P. The MFP may send and receive an image of the document communicating with a facsimile placed at a distant place. The MFP may print image information which is processed with a computer.

The image forming apparatus 100 includes an image forming unit 1, a paper supply unit 2, a document read unit 3 and an paper-output stock unit 4. The paper supply unit 2 has multistage paper trays 21 which stock the recording mediums, for example, plain papers, OHP (over head projector) sheets, tracing papers and so on. Each paper tray 21 is configured to be released from the image forming apparatus 100. A sensor is arranged at the image forming apparatus 100 to sense that the paper tray 21 is released.

An optional paper supply unit 22 can be installed additionally if necessary. A manual tray 140 configured to be openable and closable is arranged on a right side of the image forming unit 1. When the manual tray 140 is opened by being separated from the main body of the image forming apparatus 100 with an upper portion of the manual tray 140 as shown in FIG. 1, a bunch of the recording mediums can be stocked onto the manual tray 140. A manual-tray sensor may be arranged to detect whether paper is stocked on the manual tray 140. The document read unit 3 is arranged over the image forming unit 1 to read a document. The paper-output stock unit 4 is arranged on a left side of the image forming unit 1 to stock the recording medium having the printed image.

The image forming unit 1 is arranged at a middle of the image forming apparatus 100 and includes an intermediate transfer belt 5, image forming devices 6, an exposure unit 7 and a fixing apparatus 8. The four image forming devices 6 which form a four color image are arranged in parallel to face the intermediate transfer belt 5 formed endlessly.

Each image forming devices 6 includes a photosensitive drum 61. Around photosensitive drum 61, a charging device 62 is arranged to charge a surface of the photosensitive drum 61. The four image forming devices 6 further includes a development device 63 and a cleaning device 64. The development device 63 visualizes an electrostatic latent image which is formed on the photosensitive drum 61 by exposing a laser light. The cleaning device 64 removes and collects residual toner on the photosensitive drum 61.

The document read unit 3 includes reader running units 32 and 33. The reader running units 32 and 33 includes a document-illumination source and mirrors and are configured to move back and forth to scan to read a document placed on a contact glass 31. During the scan, a document image is read and detected as an image signal by a CCD (charge coupled device) 35 arranged posterior to a lens 34. The image signal is digitized so that image forming processing is processed.

Based on the executed signal of the image forming process, a laser diode (LD) emits a laser light. The laser light is exposed onto the surface of the photosensitive drum 61 so as to form an electrostatic latent image on the photosensitive drum 61. The laser light arrives at the photosensitive drum 61 through polygon mirror and lens. An auto document feeder 36 is attached over the document read unit 3 to feed document automatically.

Around the intermediate transfer belt 5, a transfer device 51 and an intermediate transfer cleaning device 52 are arranged. The transfer device 51 forms nip to transfer the full color image formed on the intermediate transfer belt 5 to the recording medium. The intermediate transfer cleaning device 52 removes and collects residual toner on the surface of the intermediate transfer belt 5.

An image forming process on this image forming apparatus will be described. In the image forming device 6 of FIG. 1, four color toner image is formed by a common electrophotographic process with a timing in accordance with a rotation of the intermediate transfer belt 5.

At a position of the yellow color image forming device, a yellow toner color image formed on the leftmost photosensitive drum is transferred to the intermediate transfer belt 5. At a position of the magenta color image forming device, a magenta toner color image formed on the photosensitive drum next to the photosensitive drum for the yellow color image is transferred to the intermediate transfer belt 5 by superimposing on the yellow toner color image. Similarly, at a position of the cyan color image forming device, a cyan toner color image formed on the photosensitive drum next to the magenta photosensitive drum for the magenta color is transferred to the intermediate transfer belt 5.

Further, at a position of the black color image forming device, a black toner color image formed on the photosensitive drum next to the photosensitive drum for the cyan color image is transferred to the intermediate transfer belt 5. Thus, as a result of the superimposition of four color toner images, a full color toner image is formed on the intermediate transfer belt 5 by transferring each color toner image formed on each photosensitive drum.

In parallel with the image forming processed on the intermediate transfer belt 5, a recording medium is fed one by one by being separated from a specified paper tray 21 of the paper supply unit 2. A bunch of recording mediums are piled on a baseplate 24 movably supported by the paper tray 21. By the movement of the baseplate 24, the bunch of recording mediums lifted up to a position at which a top recording medium of the bunch of the recording mediums contacts a pickup roller 25. The top recording medium is fed in accordance with a rotation of the pickup roller 25. The top recording medium is separated from a following recording medium by a reverse roller 27. The top recording medium separated is fed from the paper tray 21 by a rotation of a paper-feed roller 26 and is sent to a resist roller 23 arranged at a downstream of a convey path.

When the recording medium is conveyed to the resist roller 23, the recording medium is stopped to convey and is held at a nip formed by the resist roller 23. The resist roller 23 is controlled to start to rotate at a timing so that a position of the full color image formed on the intermediate transfer belt 5 matches with a position of a leading edge of the recording medium with a designated positional relationship. By the rotation of the resist roller 23, the recording medium held is to be fed again. The full color image formed on the intermediate transfer belt 5 is transferred onto the recording medium at a designated position by the transfer device 51.

The recording medium having the full color image transferred is conveyed to the fixing apparatus 8. The fixing apparatus 8 fixes the full color image transferred by the transfer device 51 onto the recording medium. The recording medium is output to the paper-output stock unit 4 by paper-output rollers 41.

When a double-side image forming is performed, the recording medium is separated at a separation device (not shown) and is turned over by passing through a double-side unit (not shown). Then, the recording medium is sent to the nip of the resist roller 23. A backside image is formed at a backside of the recording medium after an adjustment of a skew caused while conveying.

FIG. 2 illustrates a schematic of the transfer device 51 of FIG. 1. The transfer device 51 includes a transfer roller 110, a support mechanism 120 and a coil spring 150 and forms a transfer nip. The support mechanism 120 supports the transfer roller 110. The coil spring 150 gives pressure to the transfer roller 110.

The transfer roller 110 is a roller with a light weight and a low inertial force. The transfer roller 110 has a pipe shape having a hollow cylinder and is formed with materials having a specific gravity of 2.8, for example, aluminum, alloy aluminum high-strength resin and so on. An elastic rubber is formed on the surface of the transfer roller 110. The support mechanism 120 includes a support release member 130 and an arm 121. The support release member 130 is attached to a roller bearing 110*b* engaged with a shaft 110*a* which is extending from the transfer roller 110. The arm 121 supports the transfer roller 110 via the support release member 130 and is rotatably attached to the main body of the image forming apparatus 100 by an attachment pin 122.

The support mechanism 120 is pushed upwards by the coil spring 150. The support mechanism 120 and the transfer roller 110 are configured to move up and down as one piece because of a following reason. The transfer roller 110 is a light weight roller with a low inertial force as described. If the transfer roller 110 moves up and down by being affected by an irregularity of a thickness of the recording medium P, the transfer roller 110 may not give a stable pressure to the intermediate transfer belt 5 to transfer the image.

In this example embodiment, the transfer roller 110 can move smoothly because the support mechanism 120 and the transfer roller 110 move up and down as one piece so that the support mechanism 120 works like a flywheel. Further, a weight of the support mechanism 120 is determined to be heavier than the weight of the transfer roller 110 so as to work well as a flywheel.

Figure 3:
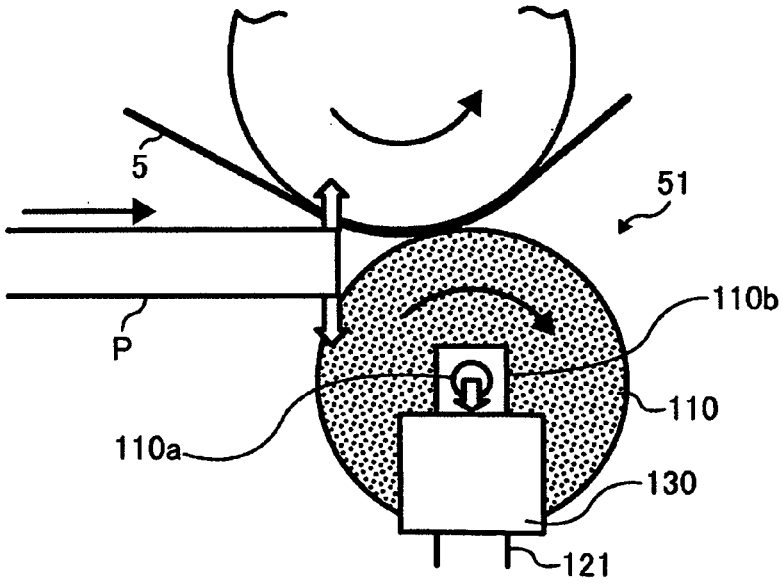
FIG. 3 illustrates a schematic of a transfer nip of the transfer device to explain a situation in which a leading edge of the recording medium goes into the transfer nip.

FIG. 3 illustrates a schematic of the transfer nip of the transfer device 51 to explain a situation in which a leading edge of the recording medium P goes into the transfer nip. A necessary space for a thickness of the recording medium P is required to be formed so that the recording medium P passes through the transfer nip. The recording medium P can not goes into the transfer nip until the necessary space for the thickness of the recording medium P is formed. The recording medium P may stack at a position immediately before the transfer nip.

If the stacking of the recording medium occurred for a relatively long time, a load to the intermediate transfer belt 5 is increased due to a friction between the recording medium P and the intermediate transfer belt 5. Due to the increase of the load of the intermediate transfer belt 5, a speed of the intermediate transfer belt 5 may change. As a result, an uniformity of the color density which is called a shock jitter is occurred.

If the recording medium P is thin, a necessary space for the thickness of the recording medium P may be formed by a reform of the rubber layer of the transfer roller 110. The thin recording medium P can easily pass the transfer nip because the necessary space for the thin recording medium P is small and can be formed in a short time. Thus, when the recording medium P is thin, a load of the intermediate transfer belt 5 due to the friction between the recording medium P and the intermediate transfer belt 5 is not increased because the stacking time is short. As a result, the speed of the intermediate transfer belt 5 is kept constant so as to avoid a shock jitter.

If the recording medium P is thick and has a basic weight of at least 60 [g/m$^2$], it is not possible to obtain a necessary space for the thickness of the recording medium P only by the reform of the rubber layer of the transfer roller 110. It is needed that the transfer roller 110 is retracted by the leading edge of the recording medium P to form the necessary space. The recording medium P can not go into the transfer nip and stacks at a position immediately before the transfer nip until the necessary space for the thickness of the recording medium P is formed.

During the stack of the recording medium P, a load to the intermediate transfer belt 5 is increased due to a friction between the recording medium P and the intermediate transfer belt 5. Due to the increase of the load of the intermediate transfer belt 5, the speed of the intermediate transfer belt 5 may change. As a result, an uniformity of the color density which is called a shock jitter is occurred during transferring the image to the intermediate transfer belt 5.

The transfer roller 110 is needed to be retracted to form a space in a short time such that the recording medium P can pass the transfer nip without a slowing down i.e., without stopping at the position immediately before the transfer nip. If the conveying speed of the recording medium P is increased, the transfer roller 110 is needed to be retracted in much shorter time to form the necessary space. A necessary force to move the transfer roller 110 by a thickness of the recording medium P depends on an inertial force of the transfer roller 110 and the support mechanism 120 and a drag force of the coil spring 150. The inertial force system will be focused and described.

If the conveying speed of the recording medium P is slow, a slower retraction of the transfer roller 110 is allowed to form a necessary space for the recording medium P passing through the transfer nip without stack of the recording medium P at the position immediately before the transfer nip. The inertial force of the transfer roller 110 and the support mechanism 120 can be smaller values. The necessary force to move the transfer roller 110 depends mostly on the drag force of the coil spring 150 which pushes the transfer roller 110 and the arm 121 to the intermediate transfer belt 5. The recording medium P can be conveyed without stacking at the position immediately before the transfer nip by adjusting a spring constant of the coil spring 150.

If the conveying speed of the recording medium P is faster, the transfer roller 110 is needed to be retracted in a shorter time. A quicker retraction of the transfer roller 110 is requested to avoid the stacking of the recording medium P at the position immediately before the transfer nip. In this case, a rapid acceleration of the transfer roller 110 and the support mechanism 120 is needed. The inertial force of the transfer roller 110 and the support mechanism 120 becomes large due to the large accelerated velocity. The inertial force is so large enough to neglect the drag force of the coil spring 150.

The inertial force is generally proportional to square of the a speed and is depending on a mass. If the masses of the transfer roller 110 and the support mechanism 120 are large, the inertial force is larger. (When the support mechanism 120 is rotatably supported by one supporting point as shown in FIG. 2, an equivalent value which is calculated based on the transfer roller 110 and the support mechanism 120 will be used.)

To make the necessary force smaller, a transfer roller 110 having a smaller mass and a lower inertial force may be proposed to use. If the transfer roller 110 having a smaller mass is used, however, the transfer roller 110 is affected by small irregularities of the recording medium P. As a result, the transfer roller 110 can not give a designated pressure to the intermediate transfer belt 5.

In this example embodiment, the transfer roller 110 is supported by the support mechanism 120 at a position between the transfer roller 110 and the support mechanism 120 during a normal operation. During the normal operation, the inertial force is large because the transfer roller 110 and the support mechanism 120 move as one unit. As a result, the transfer roller 110 is not affected by the small irregularities of the recording medium P.

When a leading edge of the recording medium P having a thickness greater than a reference thickness value is going into the transfer nip, the support release member 130 releases the transfer roller 110 from the support mechanism 120 so that the transfer roller 110 and the support mechanism 120 do not move as one unit. As a result, a value of the drag force to the recording medium P which is located in a side of the transfer roller 110 is equal to a value of the inertial force of the transfer roller 110.

The leading edge of the recording medium P can easily push the transfer roller 110 away. The recording medium P can pass the transfer nip in a relatively short time without stacking at the position immediately before the transfer nip. The load of the intermediate transfer belt 5 is not increased so that a shock jitter is avoided. The release mechanism 130 will be described in detail referring to a few example embodiments.

Figure 4A:
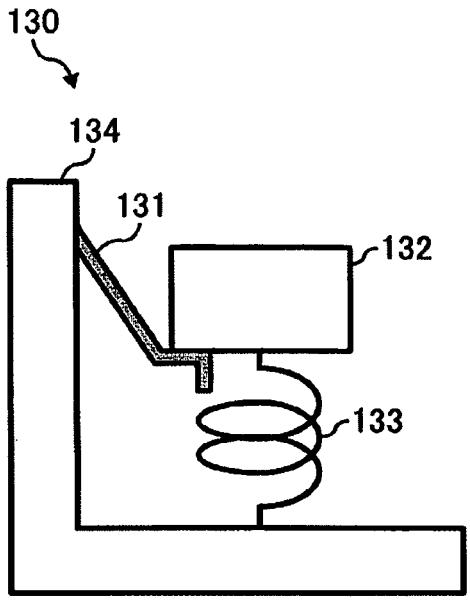
FIGS. 4A and 4B illustrate schematics of the release mechanism.
Figure 4B:
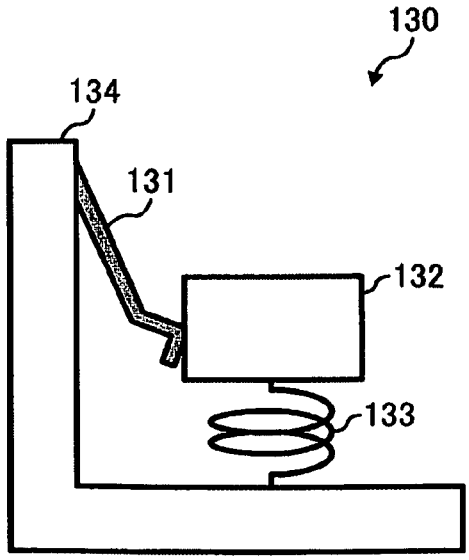

FIGS. 4A and 4B illustrate schematics of the release mechanism 130. FIG. 4A is an illustration of the release mechanism 130 when a thick recording medium P is not passing through the transfer nip. FIG. 4B is an illustration of the release mechanism 130 when the thick recording medium P is passing through the transfer nip.

The release mechanism 130 includes a plate-shaped spring 131, a moving member 132, a coil spring 133 and a base member 134. The release mechanism 130 is configured to change the spring constant of the spring rapidly in a nonlinear way when the moving member 132 is pressed down. The moving member 132 is attached on the base member 134 via the coil spring 133. The moving member 132 is configured to move up and down by a guide member (not shown).

On the upper surface of the moving member 132, a bearing is arranged to engage with the shaft 110*a* of the transfer roller 110. The plate-shaped spring 131 is attached to a side wall of the base member 134 with an end of the plate-shaped spring 131. The plate-shaped spring 131 has a dogleg shape at another end to support an under portion of the moving member 132.

A spring constant of the plate-shaped spring 131 is determined to be a larger number than the spring constant of the coil spring 150 which presses the transfer roller 110 and the support mechanism 120 to the intermediate transfer belt 5. A spring constant of the coil spring 133 is determined to be a smaller number than the spring constant of the coil spring 150. The arm 121 is attached at an underside of the base member 134. An operation of the release mechanism 130 will be described.

Figure 5A:
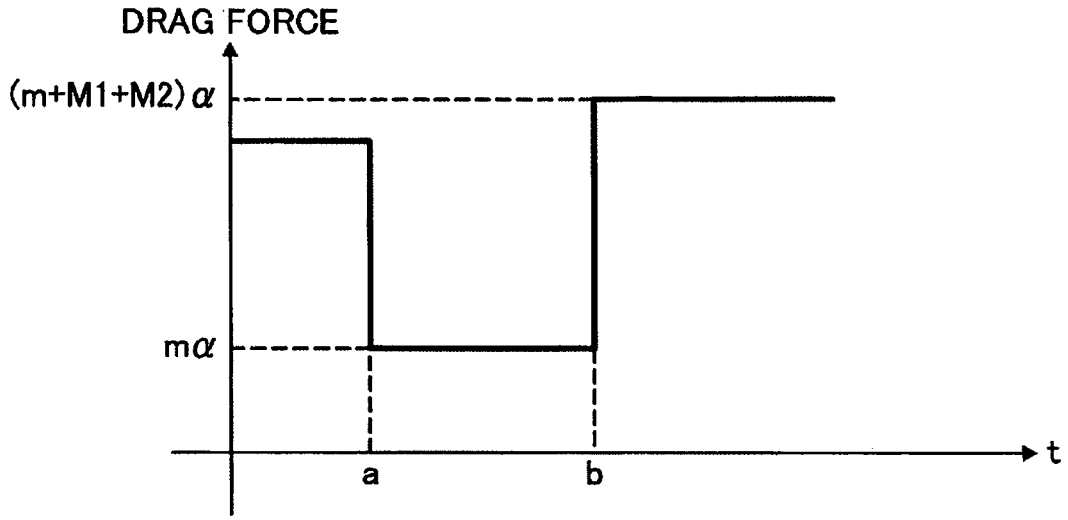
FIG. 5A illustrates a change of the drag force and FIG. 5B illustrates a change of a moving distance of the transfer roller.

FIG. 5A illustrates a change of the drag force for a time period from a time the leading edge of the recording radium hits the transfer nip to a time a space which allows the recording radium P to go into the transfer nip is created. In FIG. 5A, the drag force of the coil spring 150 is neglected because the inertial force of the transfer roller 110 and the support mechanism 120 to the recording medium P at the transfer roller side is large enough.

Figure 5B:
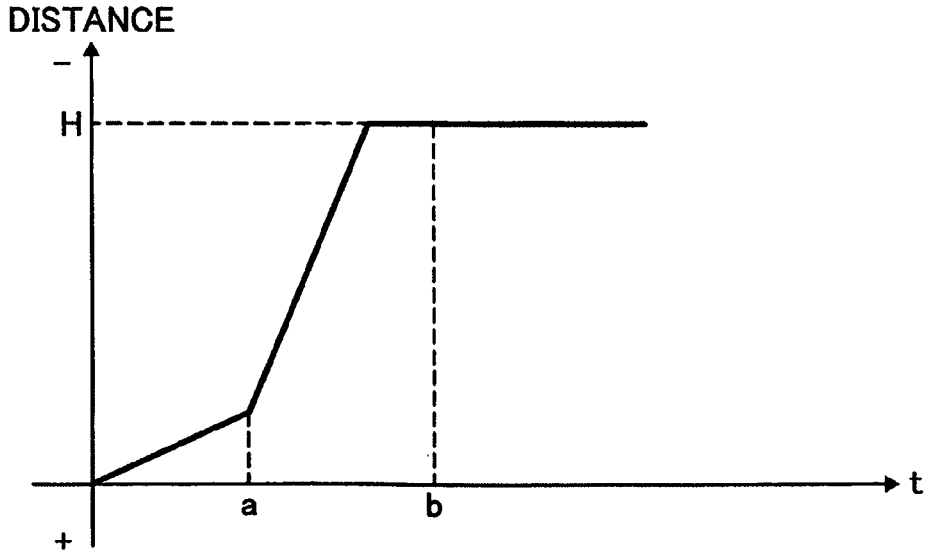

FIG. 5B illustrates a change of a moving distance of the transfer roller 110 for a time period from a time the recording medium hits the transfer nip to a time the space which allows the recording medium to go into the transfer nip is created. A point "a" in FIG. 5A is a time the plate-shaped spring 131 is released and a point "b" in FIG. 5A is a time the coil spring 133 is constricted.

When the recording medium P having a thickness greater than a reference thickness value goes into the transfer nip, the transfer roller 110, the transfer roller 110, the arm 121 and the release mechanism 130 are pushed down by a pushing force of the recording medium P. At the same time, the moving member 132 is moved downward as shown in FIG. 4B.

The drag force against the pushing force which the leading edge of the recording medium P pushes the transfer member 110 is a little bit smaller value than a value expressed by a formula $(m+M1+M2)\alpha$, where m is mass of the transfer member 110, M1 is mass of the arm 121, M2 is mass of the release mechanism 130 and $\alpha$ is an accelerated velocity of these three m, M1 and M2. This is because the transfer member 110, the arm 121 and the release mechanism 130 are not moving together exactly as one piece and the transfer member 110 is only pushed down with the downward movement of the moving member 132.

When the moving member 132 moves downward more than a designated distance, the moving member 132 is free from the support of the plate-shaped spring 131 and the coil spring 133 works dominantly. Thus, the spring constant of the release mechanism 130 rapidly decreases. The arm 121 is moved towards the transfer roller 110 by the pushing force of the coil spring 150 and the transfer roller 110 is moved towards the arm 121 by the pushing force of the recording medium P. The coil spring 133 of the release mechanism 130 is shrunk by these pushing forces.

Due to the rapid decrease of the spring constant of the release mechanism 130, a length of a supporting portion of the support mechanism 120 which supports the transfer roller 110 decreases rapidly in a direction of the thickness of the recording medium P. In this example embodiment, a length of the coil spring 133 of the release mechanism 130 decreases. As a result, a similar situation where there is no support member to support the transfer roller 110 is generated and a space between the arm 121 and the transfer roller 110 is created.

Thus, the transfer roller 110 does not move together with the arm 121. While the coil spring is shrunk from the point "a" to "b" shown in FIG. 5A, the drag force to the recording medium P at the transfer roller side becomes the inertial force of the transfer roller 110 i.e., the force is expressed by a formula $m\alpha$, where m is mass of the transfer roller 110 and $\alpha$ is an accelerated velocity of the m. Strictly speaking, an inertial force of the of the moving member 132 and a drag force of the coil spring 133 are existing. However, the inertial force of the of the moving member 132 and the drag force of the coil spring 133 are negligible small.

Thus, the coil spring is shrunk and the drag force is $m\alpha$ while a period between the points "a" and "b". A space H which is equal to the thickness of the recording medium P is quickly created by the pushing force of the leading edge of the recording medium P to the transfer roller 110. The leading edge of the recording medium P may not stack at the position immediately before the transfer nip for a relatively long time.

The recording medium P is smoothly passing through the transfer nip. The increase of the load to the intermediate transfer belt can be avoided.

As the transfer roller 110 employs a roller having a smaller mass and a lower inertial force, the drag force to the recording medium P at the transfer roller side can be made smaller in a period the coil spring is shrunk. As a result, the transfer roller 110 can be retracted quickly so that the necessary space for the thickness of the recording medium P is formed quickly. Therefore, the recording medium P enters the transfer nip smoothly without stacking at the position immediately before the transfer nip.

After the leading edge of the recording medium P have been entered the transfer nip, the coil spring 133 is fully compressed and may not work as a spring. As a result, the arm 121, the release mechanism 130 and the transfer roller 110 are pushed as one piece by the coil spring 150 to the intermediate transfer belt 5 while the recording medium P is passing through the transfer nip.

As shown in FIG. 5A, the drag force to the recording medium P at the transfer roller side becomes a value expressed by a formula $(m+M1+M2)\alpha$, where m is mass of the transfer member 110, M1 is mass of the arm 121, M2 is mass of the release mechanism 130 and $\alpha$ is an accelerated velocity of these three m, M1 and M2. As a result, a transfer pressure can be maintained stably with a designated value and without jittering of the transfer roller 110 having a low inertial force.

A threshold to release the plate-shaped spring is to be determined by experiments using actual equipment with repetition of trial-and-errors. It is repeated to print an image on recording mediums having different thicknesses using the actual equipment in which the release mechanism 130 is fixed not to work. Every printing result on the recording medium is observed checking whether the shock jitter is occurred. The thinnest recording medium is selected from among the recording mediums on which the shock jitter is occurred. Using the thinnest recording medium with which shock jitter is observed, a threshold at which the plate-shaped spring 131 releases is searched. With the example embodiment, the shock jitter is observed when the recording medium having a basic weight of equal to and more than 60 [g/m$^2$] is used.

After a trailing edge of the recording medium has passed the transfer nip, the moving member 132 is moved towards the intermediate transfer belt 5 and pushes the transfer roller 110 up. If the transfer roller 110 is lifted up by a threshold distance, the moving member 132 is supported and fixed again by the plate-shaped spring 131 as shown in FIG. 4A.

If the recording medium P is thinner than the reference thickness value, the recording medium P can pass the transfer nip keeping the configuration shown in FIG. 4A because the necessary space for the thickness of the recording medium P is quickly obtained by the reform of the rubber layer of the transfer roller 110 without release of the plate-shaped spring 131. The drag force to the recording medium P at the transfer roller side is a value expressed by a formula $(m+M1+M2)\alpha$, where m is mass of the transfer member 110, M1 is mass of the arm 121, M2 is mass of the release mechanism 130 and $\alpha$ is an accelerated velocity of these three m, M1 and M2. Therefore, a transfer pressure can be maintained stably with a designated value and without jittering of the transfer roller 110 having a low inertial force.

Figure 6A:
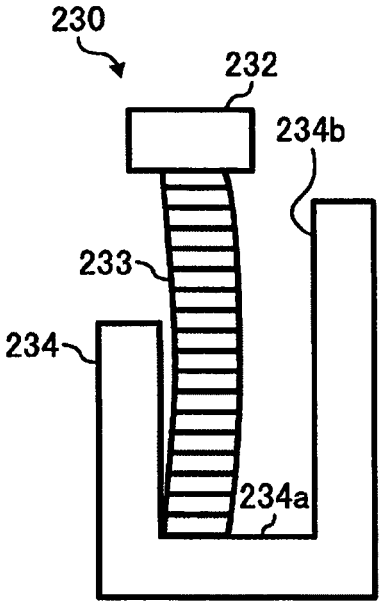
FIGS. 6A and 6B illustrate an absorbing mechanism according to a second example embodiment.
Figure 6B:
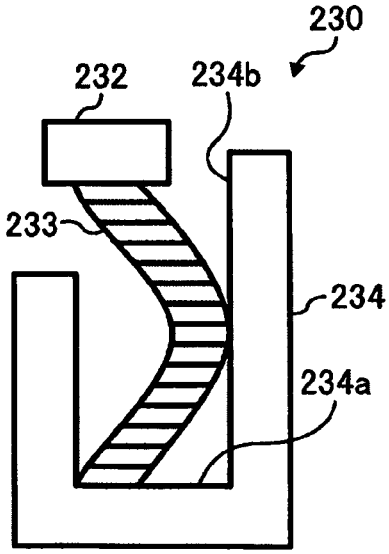

FIGS. 6A and 6B illustrate an absorbing mechanism 230 according to a second example embodiment. FIG. 6A is a schematic of the absorbing mechanism 230 when a thick recording medium P is not passing through the transfer nip. FIG. 6B is a schematic of the absorbing mechanism 230 when a thick recording medium is passing through the transfer nip.

The absorbing mechanism 230 includes a moving member 232, a solenoid coil spring 233 and a base member 234. The moving member 232 is attached on the base member 234 via the solenoid coil spring 233. The moving member 232 is configured to move up and down by a guide member (not shown). On the upper surface of the moving member 232, a bearing is arranged to engage with the shaft 110*a* of the transfer roller 110. The base member 134 is attached at the arm 121.

The solenoid coil spring 233 is attached to a base surface 234*a* of the base member 234 at a left end portion of the base member 234 as shown in FIG. 6A. The solenoid coil spring 233 has a shape of a circular arc. A middle of the circular arc of the solenoid coil spring 233 slightly deviates from a straight line to a right direction with an almost fully compressed condition. Thus, the solenoid coil spring 233 is not fully compressed when a thick recording medium P is not passing through the transfer nip. If the solenoid coil spring 233 is fully compressed, a small positional change of the transfer roller 110 may cause a buckling of the solenoid coil spring 233. A spring constant of the solenoid coil spring 233 is determined to be a larger number than the spring constant of the coil spring 150 which presses the transfer roller 110 and the support mechanism 120 to the intermediate transfer belt 5.

When the recording medium P having a thickness greater than a reference thickness value passes through the transfer nip, the leading edge of the recording medium P pushes the transfer roller 110 downward of FIG. 6A. The moving member 232 which is attached to the bearing 110*a* of the transfer roller 110 is moved downward as shown in FIG. 6B.

If a distance of the moving member 232 to be pushed down is smaller than a threshold, the solenoid coil spring 233 maintains a designated drag force to a compression force. The drag force to the recording medium P at the transfer roller side becomes almost equal to a value expressed by a formula $(m+M1+M2)\alpha$, where m is mass of the transfer member 110, M1 is mass of the arm 121, M2 is mass of the release mechanism 130 and $\alpha$ is an accelerated velocity of these three m, M1 and M2.

If the moving member 232 is moved down more than the threshold, the solenoid coil spring 233 is fully compressed and does not work as a spring. The solenoid coil spring 233 buckles to a right side as shown in FIG. 6B and looses the drag force. The transfer roller 110 experiences a similar situation in which the transfer roller 110 looses any support. The arm 121 moves to the transfer roller 110 by the pushing force of the coil spring 150. The transfer roller 110 moves to the arm 121 by the pushing force of the recording medium P. The solenoid coil spring 233 contacts with a right side wall 234*b* of the base member 234 as shown in FIG. 6B.

Thus, the solenoid coil spring 233 which supports the transfer roller 110 buckles and a length of the portion of the solenoid coil spring 233 decreases rapidly in a direction of the thickness of the recording medium P. Until the solenoid coil spring 233 contacts a right side wall 234*b* of the base member 234 as shown in FIG. 6B, the transfer roller 110 experiences a similar situation in which the transfer roller 110 looses the support. The drag force to the recording medium P at the transfer roller side becomes the inertial force expressed by a formula $m\alpha$, where m is mass of the transfer roller 110 and $\alpha$ is an accelerated velocity of the m.

When the solenoid coil spring 233 buckles by pushing the transfer roller 110 downward with the leading edge of the recording medium P, a space which is equal to the thickness of the recording medium P is quickly created. The leading edge of the recording medium P may not stack at the position immediately before the transfer nip for a relatively long time. The recording medium P is smoothly passing through the transfer nip. A threshold with which the solenoid coil spring 233 buckles is to be determined by experiments using actual equipment after repeating trial-and-errors.

When the solenoid coil spring 233 buckles and contacts with the right side wall 234*b* of the base member 234, the solenoid coil spring 233 can not bend further. Therefore, after the necessary space for the thickness of the recording medium P is formed, the transfer roller 110, the arm 121 and the release mechanism 130 are pushed as one piece by the coil spring 150 to the side of the intermediate transfer belt. Therefore, while the recording medium P is passing through the transfer nip, a transfer pressure can be maintained stably with a designated value and without jittering of the transfer roller 110 having a low inertial force.

When the trailing edge of the recording medium P passes through the transfer nip, the solenoid coil spring 233 is forced back to straighten up. When the length of the solenoid coil spring 233 becomes above a threshold, the solenoid coil spring 233 is released from the buckling so as to get back gain to the condition of FIG. 6A.

A release mechanism 330 according to a third example embodiment will be described. The release mechanism 330 includes a power detection sensor and an actuator 333. The power detection sensor detects a power from the recording medium P to push the transfer roller 110. When the power detection sensor detects a certain power, the actuator 333 is driven to rapidly decrease the length of the actuator to generate a similar condition in which the transfer roller 110 looses the support with the transfer roller 110 and the arm 121. The drag force (equal to the inertial force) is reduced when the leading edge of the recording medium P pushes the transfer roller 110.

Figure 7:
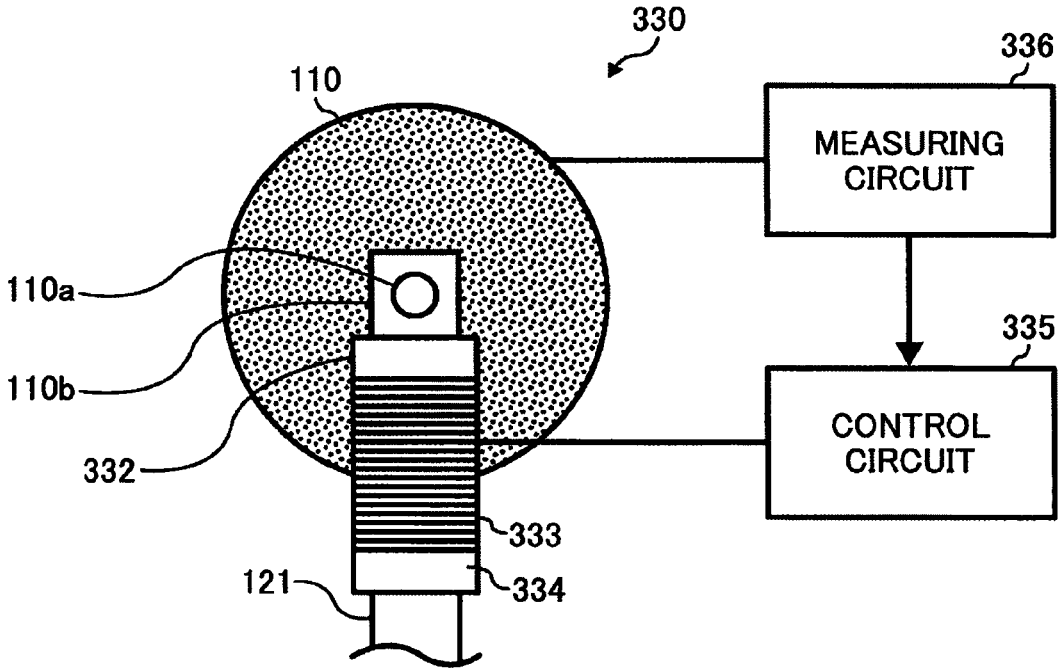
FIG. 7 illustrates the release mechanism according to the third example embodiment.

FIG. 7 illustrates the release mechanism 330 according to the third example embodiment. The release mechanism 330 further includes a moving member 332 and a base member 334 in addition to the actuator 333. Similarly to the first and second example embodiment, a bearing with which the shaft 110*a* of the transfer roller 110 is engaging is attached. The base member 334 is fixed to the arm 121. The moving member 332 is connected to the base member 334 via the actuator 333.

As for the actuator 333, a various sorts of actuators can be selected from among, for example, a piezoelectric device using electric and magnetic strain, an electromagnetic actuator such as voice coil and an electrostatic actuator using an electrostatic force. In this third example embodiment, the piezoelectric device is used. The piezoelectric device is connected to a control circuit 335 by electric wires (not shown).

Figure 8:
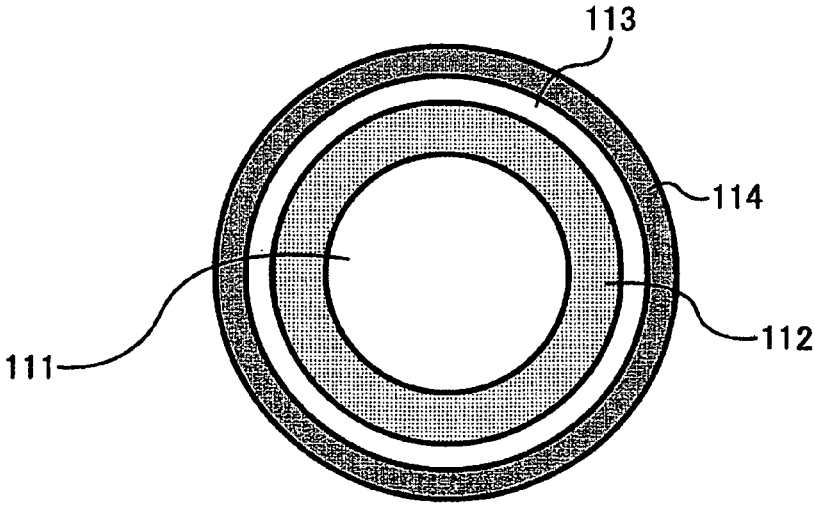
FIG. 8 illustrates a cross sectional view of a power detection sensor.

FIG. 8 illustrates a cross sectional view of the power detection sensor. A pressure-sensitive resistance film is used to form the power sensor. As shown in FIG. 8, a pressure-sensitive resistance film layer 114 is formed on a surface of a metallic film layer 113 which is arranged on a rubber layer 112 formed on a core metal 111 of the transfer layer 110. The pressure-sensitive resistance film layer 114 is connected to a measurement circuit 336 by electric wires (not shown).

When the recording medium P pushes the transfer roller 110, a resistance value of the pressure-sensitive resistance film layer 114 changes. By detecting the resistance value of the pressure-sensitive resistance film layer 114, a pushing force of the recording medium P is detected. The actuator 333 besides the pressure-sensitive resistance film layer 114 may be used as the power sensor.

If the piezoelectric device is installed, an electric and magnetic strain is occurred when the pushing force of the recording medium P is transmitted to this piezoelectric device. A pushing force of the recording medium P can be detected by detecting the electric and magnetic strain.

If the electromagnetic actuator such as voice coil is installed, an electric signal is changed when the recording medium P pushes the transfer roller 110. A pushing force of the recording medium P can be detected by detecting the change of the electric signal. If the electrostatic actuator is installed, a capacitance is changed when the recording medium P pushes the transfer roller 110. A pushing force of the recording medium P can be detected by detecting the change of the capacitance signal.

It is an indirect measurement via the transfer roller 110 to use the actuator 333 to detect the pushing force of the recording medium P. Therefore, the measurement using the actuator 333 may have a slightly longer time rag in comparison with the direct measurement to use the pressure-sensitive resistance film layer 114 to detect the pushing force of the recording medium P. It may delay more to drive the actuator 333 in comparison with the direct measurement of the pushing power using the pressure-sensitive resistance film layer 114. The direct measurement to detect the pushing power for the transfer roller 110 using the pressure-sensitive resistance film layer 114 may be able to prevent the recording medium P more steadily from stacking at the position immediately before the transfer nip in comparison with the indirect measurement using the actuator 333.

Figure 9:
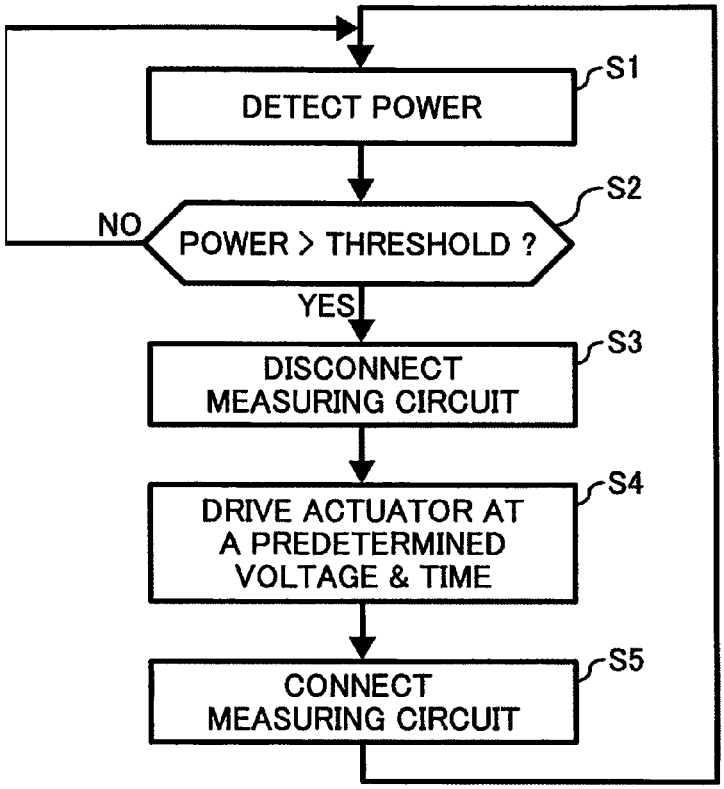
FIG. 9 illustrates a flow chart to control the release mechanism according to the third example embodiment.

FIG. 9 illustrates a flow chart to control the release mechanism 330 according to the third example embodiment. The power sensor detects the pushing power of the recording medium P to the transfer roller 110. (S1) The resistance of the pressure-sensitive resistance film layer 114 is detected. (when the pressure-sensitive resistance film layer 114 is used as the power sensor) A signal, for example, a voltage generated by the actuator 333 is detected. (when the actuator 333 is used as the power sensor) After the detection, it is checked whether the detected value (voltage, resistance and so on) exceeds the threshold. (S2)

The threshold is a power detected by a power detection sensor when the leading edge of the thinnest recording medium contacts and pushes the transfer roller 110 based on experiments using a thinnest recording medium on which the shock jitter is observed. If the power is the above threshold, (YES in S2) the measurement circuit 336 is shut off for a safety reason of the measurement circuit 336 of the power detection sensor. (S3) A certain voltage is applied for a designated period to the actuator 333. (S4) The piezoelectric device rapidly shrinks and forces the moving member 332 and the base member 334 to get closer.

During the shrink of the piezoelectric device, the transfer roller 110 moves to a side of the arm 121 and the arm 121 moves to a side of the transfer roller 110. The transfer roller 110 and the arm 121 do not move together as one piece. A similar situation in which the transfer roller 110 looses the support is generated due to the rapid shrunk of the piezoelectric device. The drag force to the recording medium P at the transfer roller side becomes the inertial force expressed by a formula $m\alpha$, where m is mass of the transfer roller 110 and $\alpha$ is an accelerated velocity of the m. Figuratively speaking, a situation as if the leading edge of the recording medium kicks off the transfer roller 110 with no weight to the arm side is generated.

The necessary space for the thickness of the recording medium P is formed quickly so that the recording medium P may not be stacked at the position immediately before the transfer nip. If the piezoelectric device shrinks more quickly, the drag force to the recording medium P at the transfer roller 110 can be reduced more rapidly.

A maximum stroke of the piezoelectric device is defined to be a distance equal to the space between the intermediate transfer belt 5 and the transfer roller 110 for a maximum thickness of the recording medium which the image forming apparatus can handle. For example, if the maximum thickness of the recording medium P which the image forming apparatus 100 can handle is a thickness similar to a containerboard, the stroke of the piezoelectric device may be enough to be 1 [mm].

After a time period, the piezoelectric device is stretched by shutting off with the power to the piezoelectric device. The transfer roller 110 is contacted to the recording medium P. The power sensor and the measurement circuits are connected again. (S5) These steps are repeated. While the recording medium P is passing through the transfer nip, the transfer roller 110 does not jitter because the arm 121 and the transfer roller 110 moves as one piece and pushes the recording medium P by the coil spring 150.

The maximum stroke of the piezoelectric device can be a different value flexibly depending on the thickness of the recording medium P. A threshold corresponding to a recording medium to be used and a suitable voltage to be applied to the piezoelectric device may be input in a table and stored in a memory. If the recording medium P is thicker, a power which the leading edge of the recording medium P pushes the transfer roller 110 is stronger.

When the power is detected by the detection sensor, the threshold corresponding to the detected power is searched. A voltage corresponding to the threshold is applied to the piezoelectric device. The transfer roller 110 moves down to the arm 121 by a corresponding distance to the thickness of the recording medium P. The space between the intermediate transfer belt 5 and the transfer roller 110 is to be equal to the thickness of the recording medium. Further, the voltage to be applied to the piezoelectric device is controlled with a waveform so as to avoid undesired vibration of the piezoelectric device.

When the trailing edge of the thick recording medium P passes through the transfer nip, the actuator 333 may be driven to rapidly increase the length of the actuator 333. During a time period from a time the trailing edge of the thick recording medium P passes through the transfer nip to a time the transfer roller 110 contacts the intermediate transfer belt 5, the intermediate transfer belt 5 experiences a similar situation to have no load. The speed of the intermediate transfer belt 5 may change to cause an uniformity of the color density.

With this reason, the transfer roller 110 may be configured to quickly contact the intermediate transfer belt 5 by driving the actuator 333 immediately after the trailing edge of the thick recording medium P passes through the transfer nip. Thus, the time period from a time the trailing edge of the thick recording medium P passes through the transfer nip to a time the transfer roller 110 contacts the intermediate transfer belt 5 again is made short. The time period the transfer roller 110 has no load becomes short. As a result, it is possible to avoid an uniformity of the color density due to the speed change of the intermediate transfer belt 5.

More specifically, the resistance of the pressure-sensitive resistance film layer 114 becomes a lower value by the transferring pressure while the recording medium P passes through the transfer nip. After the trailing edge of the thick recording medium P has passed through the transfer nip, no pressure is applied to the pressure-sensitive resistance film layer 114 and the resistance of the pressure-sensitive resistance film layer 114 changes. When the change is detected, the actuator 333 is stretched by driving the actuator 333.

The distance to be stretched is determined to be the equal thickness of the recording medium P. Thus, the transfer roller 110 moves rapidly to a side of the intermediate transfer belt 5 so as to contact the intermediate transfer belt 5. Thus, the time period from a time the trailing edge of the thick recording medium P passes through the transfer nip to a time the transfer roller 110 contacts the intermediate transfer belt 5 is made short. The change of the load of the intermediate transfer belt 5 which causes the speed change of the intermediate transfer belt 5 can be made relatively small. As a result, it is possible to avoid an uniformity of the color density due to the speed change of the intermediate transfer belt 5.

If the control described in the third example embodiment is performed only for a time period from a time the leading edge of the recording medium P is expected to enter the transfer nip to a time the trailing edge of the recording medium P is expected to pass through the transfer nip, the durability of the release mechanism will be improved. When the recording medium P is fed from the resist roller 23, a power sensor has been detecting a power for a time period. If the power is not detected during the time period, an alarm signal may be output to inform an user of an occurrence of paper jam. Thus, the power detection mechanism can be used both as the power detection mechanism and the jam detection mechanism.

A release mechanism 430 according to a fourth example embodiment will be described. The release mechanism 430 detects with the transfer voltage or the transfer current whether the leading edge of the recording medium contacts the transfer roller 110. The actuator 433 is driven by this detection result.

Figure 10:
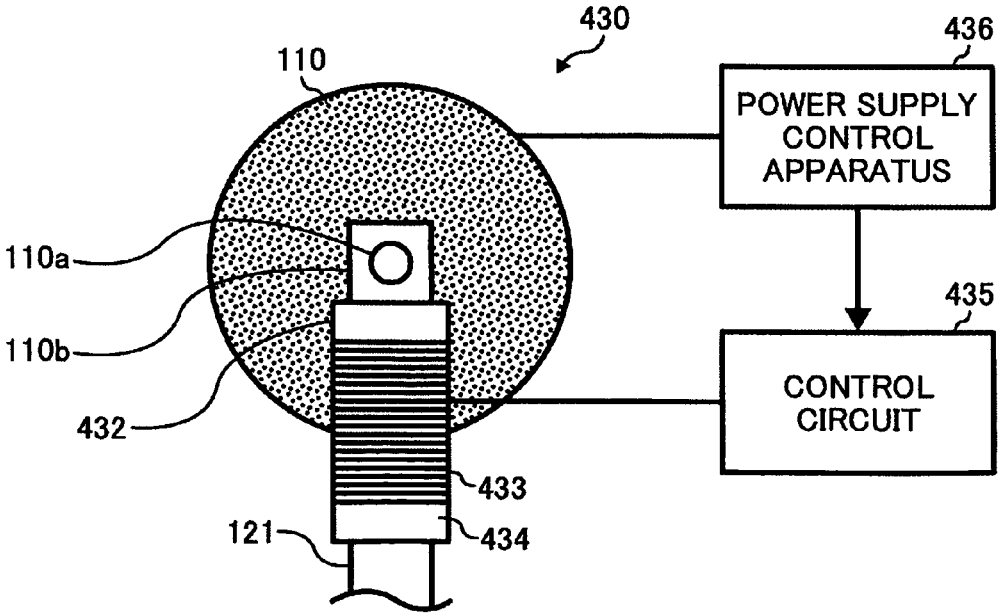
FIG. 10 illustrates the release mechanism according to the fourth example embodiment.

FIG. 10 illustrates the release mechanism 430 according to the fourth example embodiment. Similarly to the release mechanism 330 according to the third embodiment of FIG. 7, the release mechanism 430 includes a moving member 432, an actuator 433 and a base member 434. The moving member 432 is attached to the shaft of the transfer roller 110 and the base member 434 is attached to the arm 121. The actuator 433 connects the moving member 432 and the base member 434.

The actuator 433 is connected to the control circuit 435 by electric wires (not shown). The transfer roller 110 is connected to a power control apparatus 436 which controls a transfer electric field. The power control apparatus 436 generally uses a voltage control method or a current control method. When the voltage control method is used, the power control apparatus 436 always observes the transfer voltage and controls so as to apply a constant voltage. When the current control method is used, the power control apparatus 436 always observes the transfer current and controls so as to supply a constant current. In the fourth example embodiment, the power control apparatus 436 is controlled by the current control method.

When the leading edge of the recording medium P is conveyed near an entrance of the transfer nip, a transfer electric field is temporally changed due to difference of dielectric constants between the recording medium P and the air. When the leading edge of the recording medium P contacts the transfer roller 110 and the intermediate transfer belt 5, the transfer current changes because the transfer current flows through the recording medium P.

When the leading edge of the recording medium P pushes the transfer roller 110 and a space is created between the transfer roller 110 and the intermediate transfer belt 5, the transfer current changes due to cutoff of the current flow. These phenomena are detected as a series of changes of the transfer current. The changes of the transfer current become relatively large at a time the leading edge of the recording medium contacts the transfer roller 110 and at a time the space is created between the transfer roller 110 and the intermediate transfer belt 5. It is easy to detect these relatively large changes.

There may be a delay if the actuator 433 is driven after the detection of the current change at a time the space is created between the transfer roller 110 and the intermediate transfer belt 5. The intermediate transfer belt 5 may stack at the position immediately before the entrance of the transfer nip. Therefore, as for the release mechanism 430 in the fourth example embodiment, the actuator 433 is driven by the detection of the change of the transfer current when the recording medium contacts the transfer roller 110 and the intermediate transfer belt 5.

Figure 11:
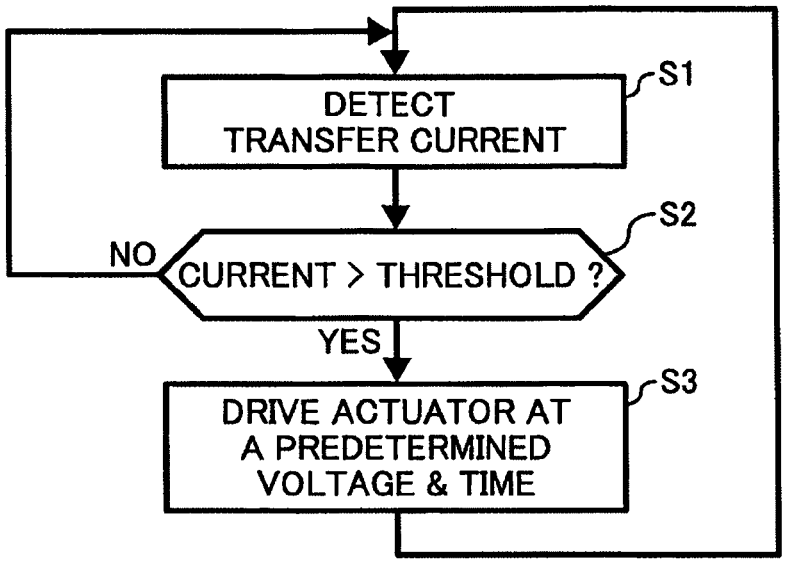
FIG. 11 illustrates a flow chart to control the release mechanism according to the fourth example embodiment.

FIG. 11 illustrates a flow chart to control the release mechanism 430 according to the fourth example embodiment. A transfer current is detected. (S1) It is detected whether the leading edge of the recording medium P contacts the transfer roller 110 and the intermediate transfer belt 5. This is judged by checking whether the current is larger comparing to a reference current stored in a memory. The reference current values is obtained by measurements using the thinnest recording medium with which the shock jitter is occurred.

When the leading edge of the recording medium contacts the transfer roller and the intermediate transfer belt 5 (i.e., When the detected current is larger the reference current value stored in a memory), (YES in S2) a voltage is applied for a time period. (S3)

The transfer roller 110 is pulled down to the side of the arm 121. After a time period, the actuator 433 is stretched by shutting off with the power to the actuator 433. The transfer roller 110 is contacted to the recording medium P. While the recording medium P is passing through the transfer nip, the transfer roller 110 does not jitter because the arm 121 and the transfer roller 110 moves as one piece and pushes the recording medium P by the coil spring 150. The transfer pressure can be maintained stably with a designated value and without jittering of the transfer roller 110.

A power is to be detected in the release mechanism 330 of the third example embodiment as previously described. The actuator 333 is driven after the leading edge of the recording medium P contacts the transfer roller 110 and the intermediate transfer belt 5 and pushes the transfer roller 110 down by some distance. In the release mechanism 430 of the fourth example embodiment, the actuator 433 can be driven immediately after the leading edge of the recording medium P contacts the transfer roller 110 and the intermediate transfer belt 5 by detecting an instantaneous change of the transfer current.

Therefore, the actuator 433 of the fourth example embodiment can be driven more quickly than the actuator 333 of the third example embodiment so as to form the space for the recording medium P. It is possible more steadily to prevent the recording medium P from stacking at the position immediately before the transfer nip in comparison with the release mechanism 330 of the third example embodiment.

The stroke of the actuator 433 can be a different value flexibly depending on the thickness of the recording medium P. The voltage to be applied to the actuator 433 may be controlled with a waveform so as to avoid undesired vibration of the actuator 433.

The actuator 433 of the fourth example embodiment may be driven when the trailing edge of the thick recording medium P passes through the transfer nip. In the fourth example embodiment, when the trailing edge of the recording medium P passes through the transfer nip, the transfer current changes by cutting a current path off due to the creation of the space between the transfer roller 110 and the intermediate transfer belt 5.

When the change of the transfer current is detected by the power control apparatus 436, the actuator 433 is stretched by the thickness of the recording medium P by driving the actuator 433. The transfer roller 110 moves rapidly to a side of the intermediate transfer belt 5 so as to contact the intermediate transfer belt 5. Thus, the time period from a time the trailing edge of the thick recording medium P passes through the transfer nip to a time the transfer roller 110 contacts the intermediate transfer belt 5 is made short. As a result, it is possible to avoid an uniformity of the color density due to the speed change of the intermediate transfer belt 5.

Figure 12:
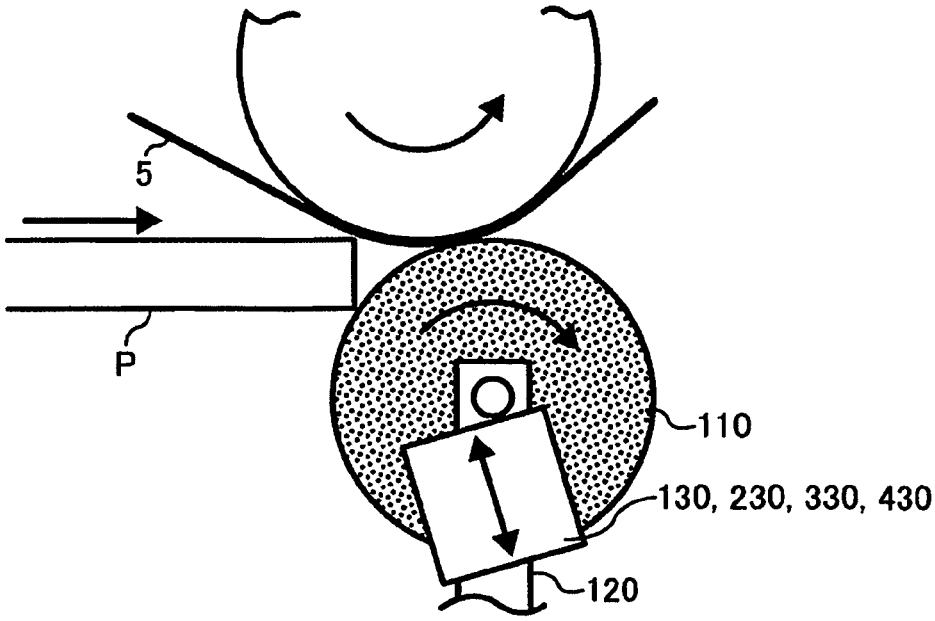
FIG. 12 illustrates another release mechanism arranged with a tilt of angle relative to the vertical direction.

The release mechanism may be arranged with a tilt of an angle relative to the vertical direction as shown in FIG. 12. The transfer roller 110 is pushed down to the side of the arm 121 and to obliquely downward from an upstream to a downstream of the convey direction of the recording medium P.

With this arrangement of the release mechanism, the recording medium P can keep moving to the convey direction without stacking at a position of entrance of the transfer nip even while the leading edge of the recording medium P is still creating a space for the recording medium P. The recording medium P can be conveyed more stably without stacking and with no jitter of the transfer roller 110 in comparison to the release mechanism which moves only in a vertical direction.

Further, it may be allowed to take a longer time that the transfer roller 110 moves downward by the equal distance with the thickness of the recording medium P because the transfer roller 110 moves together with the recording medium P to the convey direction of the recording medium P. Because slower movement of the transfer roller 110 can be acceptable to create the space equal to the thickness of the recording medium P, the transfer roller having a lower inertial force may be applicable.

With passive release mechanisms such as the first and second example embodiments, the transfer roller 110 can be pushed down with a smaller force so as to be pushed down by the recording medium P more smoothly. With active release mechanisms such as the third and fourth example embodiments, it may be allowable to push the transfer roller 110 down with slower speed.

The release mechanism described above can be applied to the fixing apparatus 8 which includes a fixing roller and a pressuring roller. A fixing nip is formed with the fixing roller and the pressuring roller which are movable devices configured to move around endlessly. When a thick recording medium is conveyed to the fixing apparatus 8 having the fixing nip, the recording medium may stack at an entrance of the fixing nip until a space equal to a thickness of the recording medium is formed. If a recording medium being conveyed is staying at the transfer nip which locates upstream to the fixing nip in a convey path of the recording medium, a convey speed may change and cause an uniformity of a color density.

The release mechanism described in the first to forth example embodiments may be used to avoid the problem. With passive release mechanisms such as the first and second example embodiments, the release mechanism changes a spring constant of the release mechanism so as to push down easily with the fixing roller or the pressuring roller when the recording medium contacts the fixing roller and the pressuring roller.

As a result, a necessary space between the fixing roller and the pressuring roller is formed without a stack of the recording medium at the entrance of the fixing nip so that the recording medium passes through the fixing nip. After the leading edge of the recording medium passing through the fixing nip, a toner image is fixed with a designated pressure because a spring is fully shrunk.

With active release mechanisms such as the third and fourth example embodiments, the fixing roller or the pressuring roller moves to a direction to release the fixing nip so as to form the space equal to the recording medium. As a result, it is avoided that the recording medium stacks at the entrance of the fixing nip. After the leading edge of the recording medium passing through the fixing nip, a toner image is fixed with a designated pressure by cutting a drive voltage for the actuator off.

Numerous additional modifications and variations are possible in light of the above teachings. It is therefore to be understood that within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus, comprising:

a first member including a surface endlessly moving in a specific direction;

a second member including a surface endlessly moving in the specific direction at a region facing the surface of the first member;

a supporting member to hold the second member and to move together with the second member, the supporting member including a release mechanism to release an engagement of the supporting member from the second member so that the supporting member and the second member are attached but do not move as one unit; and a pressing member to press the second member via the supporting member to cause the second member to contact the first member under pressure to form a nip between the first and second members, wherein the release mechanism releases the engagement of the supporting member from the second member when the second member is pushed away by a leading edge of a recording medium having a thickness greater than a reference thickness value, wherein the release mechanism includes a detector to detect a first event that the second member is pushed away by a recording medium having a thickness greater than the reference thickness value, and an actuator to be driven to move the second member away from the first member in response to a detection of the first event by the detector.

2. The image forming apparatus of claim 1, wherein the supporting member includes a supporting portion including a length to support the second member and the release mechanism rapidly reduces the length of the supporting portion of the supporting member when the second member is pushed away by a leading edge of a recording medium having a thickness greater than the reference thickness value.

3. The image forming apparatus of claim 1, wherein the first member includes an image carrier to hold an image and the second member includes a transfer roller to transfer the image held by the image carrier onto a recording medium during a time the recording medium passes through the nip.

4. The image forming apparatus of claim 1, wherein the release mechanism includes a spring mechanism which rapidly decreases a spring constant of the spring mechanism when the second member is pushed away by a leading edge of a recording medium having a thickness greater than the reference thickness value.

5. The image forming apparatus of claim 4, wherein the spring mechanism includes two springs having different spring constants, wherein the two springs normally both operate, and wherein one of the two springs having a higher spring constant is caused to be inoperable and the other one of the two springs having a lower spring constant is caused to be operable when the second member is pushed away by a leading edge of a recording medium having a thickness greater than the reference thickness value.

6. The image forming apparatus of claim 4, wherein the spring mechanism is configured to be buckling when the second member is pushed away by a leading edge of a recording medium having a thickness greater than the reference thickness value.

7. The image forming apparatus of claim 1, wherein the detector further detects a second event that a trailing edge of the recording medium having a thickness greater than the reference thickness value exits from the nip, and the actuator is driven to move the second member towards the first member in response to a detection of the second event by the detector.

8. The image forming apparatus of claim 7, wherein the detector detects the first and second events by detecting a change of one of a transfer voltage or a transfer current between the first and second members.

9. The image forming apparatus of claim 1, wherein the detector includes a sensor to detect a change of a transfer current when a recording medium contacts the second member to push away the second member.

10. The image forming apparatus of claim 4, wherein the release mechanism includes an actuator selected from among an actuator using an effect of an electric or magnetic strain, an electromagnetic actuator, and an electrostatic actuator and configured to serve as a force sensor to detect a push away of the second member by a recording medium having a thickness greater than the reference thickness value, and to be driven to rapidly decrease the spring constant of the spring mechanism in response to a detection of the push.

11. The image forming apparatus of claim 1, wherein the release mechanism releases an engagement of the supporting member from the second member to cause the second member to move in a direction of conveying the recording medium and separating away from the first member when the second member is pushed away by a leading edge of a recording medium having a thickness greater than a reference thickness value.

12. An image forming apparatus, comprising:

a first member including a surface endlessly moving in a specific direction;

a second member including a surface endlessly moving in the specific direction at a region facing the surface of the first member;

a supporting member to hold the second member and to move together with the second member, the supporting member including release means for releasing an engagement of the supporting member from the second member so that the supporting member and the second member are attached but do not move as one unit; and a pressing means for pressing the second member via the supporting member to cause the second member to contact the first member under pressure to form a nip between the first and second members, wherein the release means releases the engagement of the supporting member from the second member when the second member is pushed away by a leading edge of a recording medium having a thickness greater than a reference thickness value, wherein the release means includes a detecting means to detect a first event that the second member is pushed away by a recording medium having a thickness greater than the reference thickness value, and an actuating means to be driven to move the second member away from the first member in response to a detection of the first event by the detecting means.

13. The image forming apparatus of claim 12, wherein the supporting member includes a supporting portion including a length to support the second member and the release means rapidly reduces the length of the supporting portion of the supporting member when the second member is pushed away by a leading edge of a recording medium having a thickness greater than the reference thickness value.

14. The image forming apparatus of claim 12, wherein the first member includes holding means for holding an image and the second member includes means for transferring the held image held onto a recording medium during a time the recording medium passes through the nip.

15. The image forming apparatus of claim 12, wherein the release means includes spring means for rapidly decreasing a spring constant of the spring means when the second member is pushed away by a leading edge of a recording medium having a thickness greater than the reference thickness value.

16. The image forming apparatus of claim 15, wherein the spring means includes two springs having different spring constants, wherein the two springs normally both operate, and wherein one of the two springs having a higher spring constant is caused to be inoperable and the other one of the two springs having a lower spring constant is caused to be operable when the second member is pushed away by a leading edge of a recording medium having a thickness greater than the reference thickness value.

17. The image forming apparatus of claim 15, wherein the spring means is configured to be buckling when the second member is pushed away by a leading edge of a recording medium having a thickness greater than the reference thickness value.

18. The image forming apparatus of claim 15, wherein the release mechanism includes a detector to detect a first event that the second member is pushed away by a recording medium having a thickness greater than the reference thickness value, and an actuator to be driven to rapidly decrease the spring constant of the spring mechanism in response to a detection of the first event by the detector.

19. An image forming apparatus, comprising:

a first member including a surface endlessly moving in a specific direction;

a second member including a surface endlessly moving in the specific direction at a region facing the surface of the first member;

a supporting member to hold the second member and to move together with the second member, the supporting member including a release mechanism to release an engagement of the supporting member from the second member so that the supporting member and the second member do not move as one unit; and a pressing member to press the second member via the supporting member to cause the second member to contact the first member under pressure to form a nip between the first and second members, wherein the release mechanism releases the engagement of the supporting member from the second member when the second member is pushed away by a leading edge of a recording medium having a thickness greater than a reference thickness value, wherein the release mechanism is configured to connect the second member to the supporting member and is further configured to allow a movement of the second member to be substantially independent of a movement of the supporting member when the second member is pushed away by the leading edge of the recording medium having the thickness greater than the reference thickness value.

* * * * *